US007603728B2

(12) United States Patent
Roth

(10) Patent No.: US 7,603,728 B2
(45) Date of Patent: Oct. 20, 2009

(54) HOLDING DEVICE FOR SANITARY AND MORE PARTICULARLY BATHROOM SECTOR

(76) Inventor: Eckart Roth, Heideweg 20, 72213 Altensteig (DE)

( * ) Notice: Subject to any disclaimer, the term of this patent is extended or adjusted under 35 U.S.C. 154(b) by 526 days.

(21) Appl. No.: 11/120,349

(22) Filed: May 3, 2005

(65) Prior Publication Data

US 2005/0257346 A1 Nov. 24, 2005

(30) Foreign Application Priority Data

May 4, 2004 (DE) ..... 10 2004 021 986

(51) Int. Cl.
*A47K 3/024* (2006.01)

(52) U.S. Cl. ..... 4/577.1; 4/576.1; 248/205.7

(58) Field of Classification Search ..... 4/576.1, 4/577.1, 611; 248/205.7, 205.8, 362
See application file for complete search history.

(56) References Cited

U.S. PATENT DOCUMENTS

| | | | | |
|---|---|---|---|---|
| 2,243,794 A | | 5/1941 | Dunn | |
| 2,736,904 A | | 3/1956 | Suggs | |
| 2,807,029 A | | 9/1957 | Armstrong | |
| 3,448,468 A | | 6/1969 | Murcott | |
| 3,701,507 A | * | 10/1972 | Bell | 248/362 |
| 4,345,658 A | * | 8/1982 | Danel et al. | 248/362 |
| 4,944,478 A | | 7/1990 | Sullivan | |
| 5,249,315 A | | 10/1993 | Moylan | |

FOREIGN PATENT DOCUMENTS

| | | |
|---|---|---|
| DE | G 83 14 209.6 | 10/1984 |
| DE | 200 14 971.7 | 8/2000 |
| EP | 0 775 462 | 5/1997 |

* cited by examiner

*Primary Examiner*—Tuan N Nguyen
(74) *Attorney, Agent, or Firm*—Flynn, Thiel, Boutell & Tanis, P.C.

(57) ABSTRACT

A holding device for sanitary and more particularly bathroom sector possesses a hand grip arrangement with an associated attachment means having at least two pairs of suction heads of which the hand grip arrangement may be secured to an even surface and may be detached from same, the hand grip arrangement being coupled or able to be coupled by means of coupling means with each pair of suckers at coupling points lying between the respective suction heads of a pair of suckers.

12 Claims, 7 Drawing Sheets

Fig. 5
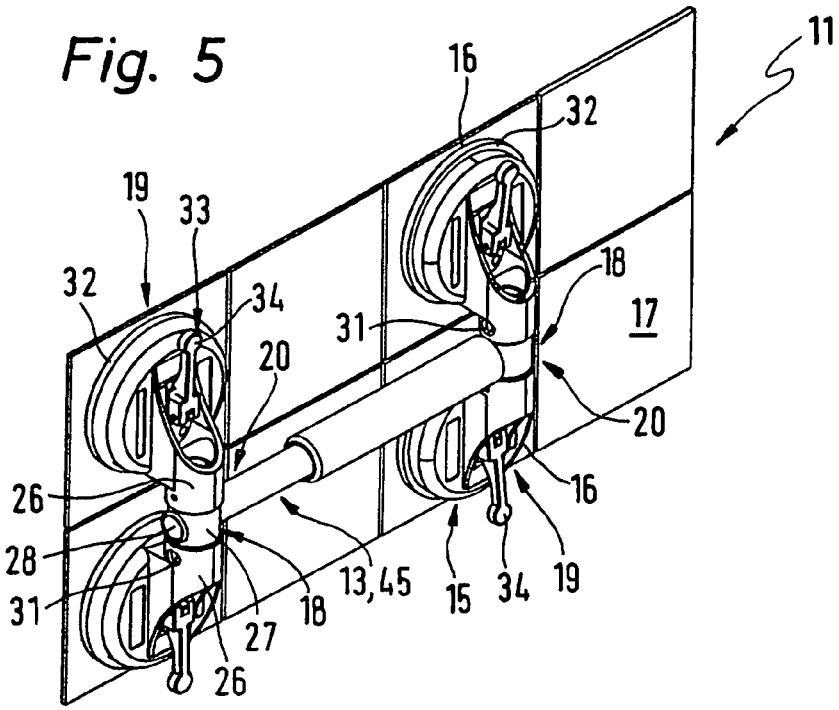
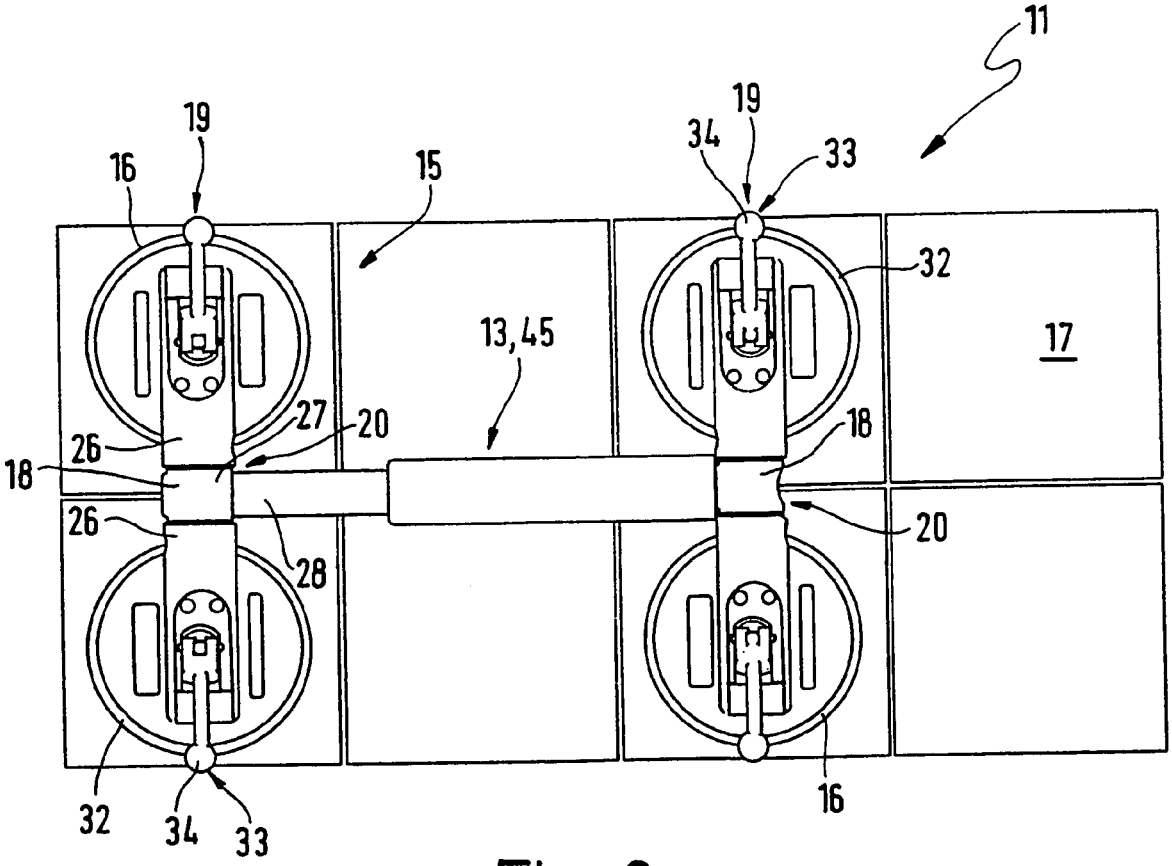
Fig. 6

Fig. 7
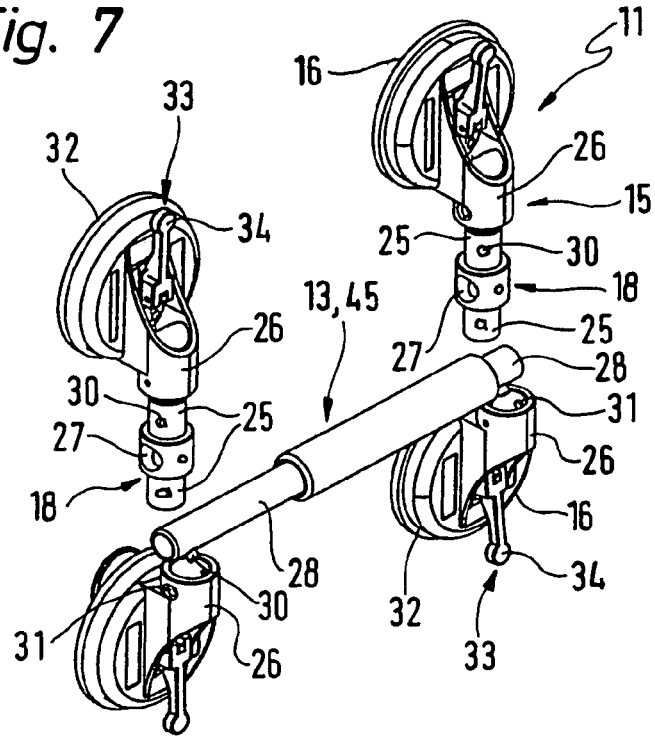
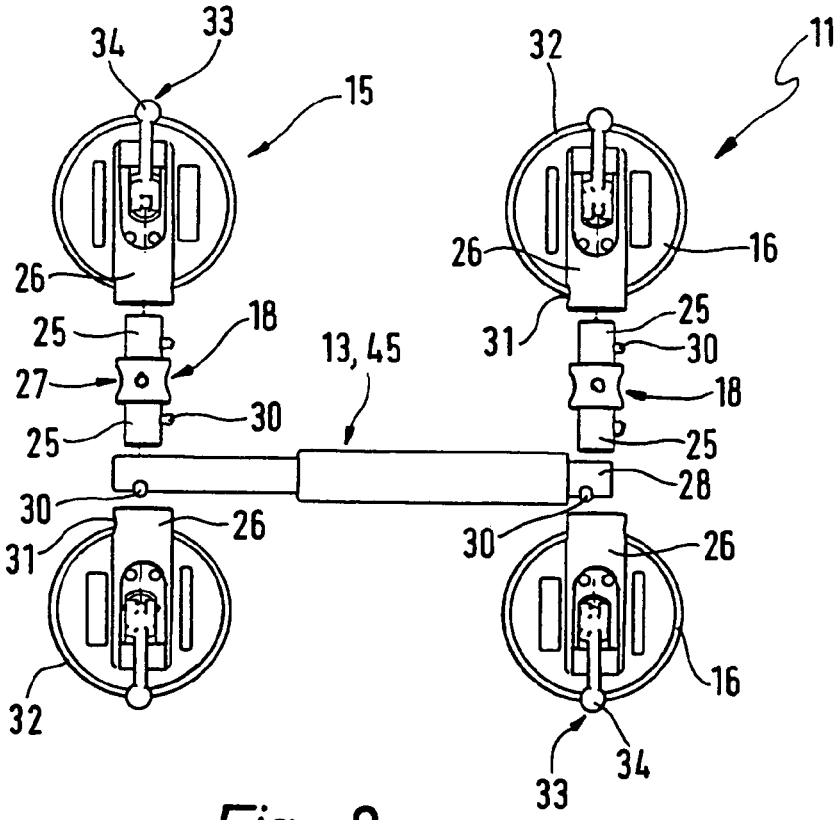
Fig. 8

Fig. 9
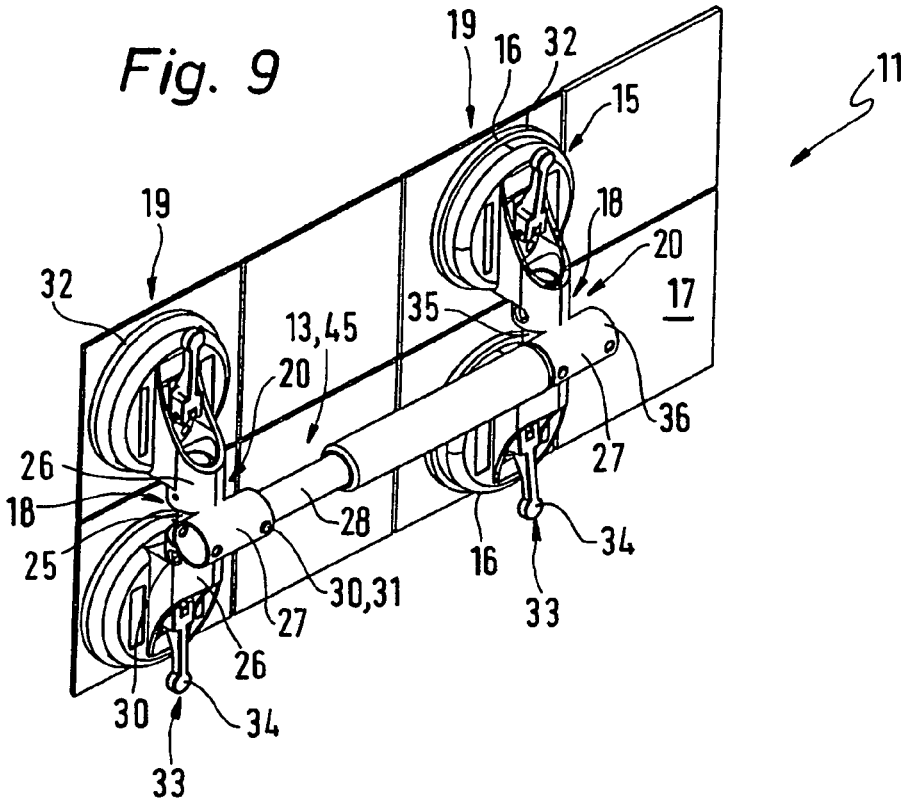
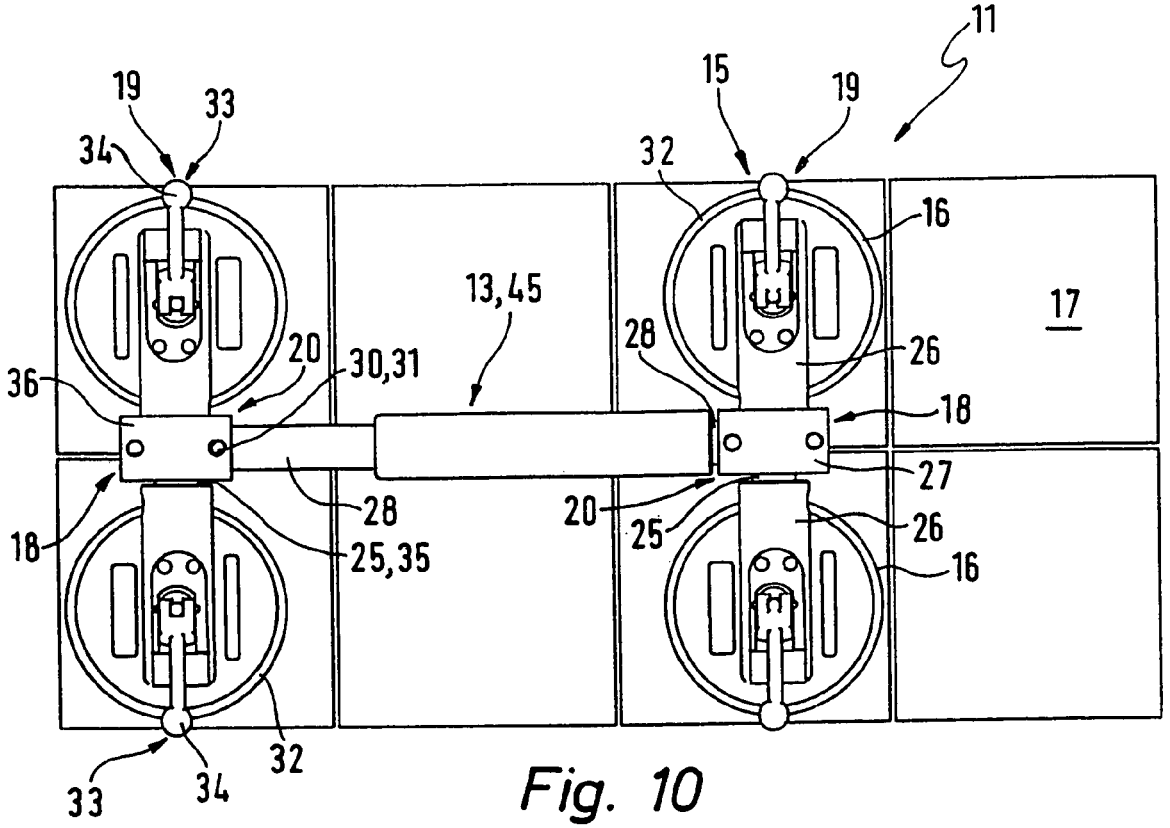
Fig. 10

HOLDING DEVICE FOR SANITARY AND MORE PARTICULARLY BATHROOM SECTOR

BACKGROUND OF THE INVENTION

The invention relates to a holding device for the sanitary and more specifically the bathroom sector.

Elderly or infirm persons must have something to hold, particularly when standing up and sitting down. This applies more particularly in the sanitary sector when using the toilet, a wash basin, a shower or a bath tub. For this purpose fixed handles are normally installed. However, there are handle arrangements on the market, which are not permanently mounted without a possibility of modification and may be employed in all cases where there is a need for a fixed handle. An only precondition is that a sufficiently even surface is available for the attachment of the hand grip device.

Although the German patent publication 20,014,971 discloses a hand grip arrangement, in the case of which a sucker is arranged at both ends of a grip rod, the holding device of the invention on the contrary entails a greater holding force in comparison, since in this case at least two pairs of suction heads or, respectively, suckers are provided. Accordingly it is possible as well for the holding device to be used by infirm or obese persons without there being a danger of the holding device being torn from the wall owing to the substantial weight of such infirm person. Since the hand grip arrangement is coupled between the respective suction heads of a pair of suckers there is furthermore a satisfactory transfer of force from the person by way of the holding device to the even surface to which the holding device is attached by suction, something which has an advantageous effect of the holding properties of the holding device.

SUMMARY OF THE INVENTION

One object of the invention is to create a holding device of the type initially mentioned, which is of more universal application than conventional holding devices.

This object is to be attained by a holding device with the features of a hand grip arrangement of this invention. Further developments of the invention are also available.

In accordance with the invention a holding device is provided for the sanitary and more specifically the bathroom sector, which possesses a hand grip arrangement with an associated attachment means, which has at least two pairs of suction heads, of which the hand grip arrangement is able to be held firmly in position on an even surface and released from it, the hand grip arrangement being coupled or being able to be coupled using coupling means with each sucker pair (i.e. pair of suckers) at coupling points lying between the respective suction heads of a sucker pair.

In the case of a further development of the invention the coupling means are constituted by components which are separate from the hand grip arrangement and the attachment means. Accordingly it is possible to apply modular principles of design and to put standard suction heads together as pairs of suckers and to combine same with the hand grip arrangement. It is particularly advantageous to use node or cross members as coupling means, the one suction head being able to be fixed to the one end of a respective node member and the other suction head being fixed to the other end, while between the two end adjacent to the suction head the hand grip arrangement is able to be coupled.

It is particularly preferred to design the node members as plug connection parts, first pins, preferably formed at a respective node member or at the associated suction heads of a sucker pair, being able to be plugged (and locked by detent means) into first sleeves, formed on the respective node member or on the associated suction heads of a sucker pair, and at least one second pin (formed on the respective node member or on the hand grip arrangement) being able to be plugged or locked into a second sleeve formed on the hand grip arrangement. The suction heads and the hand grip arrangement may therefore be simply and rapidly plugged into the node members. As an alternative it is also possible for the node members to be designed as screw or clamping parts so that the coupling of the suction heads and of the hand grip arrangement is performed by screw or clamping connection means.

It is particularly preferred for the first pins to be provided on the respective node member and the first sleeves on the associated suction heads of a pair of suckers. Accordingly it is possible to slip a sleeve-like connection member onto the suction head on the node member. Preferably the second pin is provided on the hand grip means and the second sleeve on the respective node member. As an alternative it is obviously possible as well for the first pins to be formed on the respective suction heads and the first sleeves on the respective node member and for the second pins to be provided on the node member and the second sleeve on the hand grip means. A further alternative is to design the node member generally with a pin-like configuration and to accordingly provide the components, which are to be coupled, with sleeves on them.

Each node member can be so designed that the associated sucker pair is coupled with the hand grip arrangement in a pivoting manner by means of pivot means for turning around a pivot axis extending in the longitudinal direction of the part coupled with the respective node member. Therefore the pairs of suckers may be rocked independently of each other and may be adapted to surfaces with different slopes.

In the case of a further development of the invention the hand grip arrangement is designed in the form of an arch as a bail element with a base part coupled at two coupling positions by way of coupling means, more particularly node members with at least two pairs of suckers, and a hand grip part connected with the base part and aligned athwart the base part, the base part and the hand grip part defining a bail plane, which, when the sucker pairs are aligned parallel to each other, extends parallel to the sucker plane defined by the pairs of suckers. It is more especially convenient for the base part to be constituted by the two mutually parallel longitudinal beams and for the hand grip part to be constituted by at least one transverse beam arranged transversely between the longitudinal beams and more particularly able to be shifted longitudinally.

The arch-like hand grip arrangement may for instance serve as an aid to getting into the bath tub or leaving it, the pairs of suckers being detachably secured to an inner or outer side wall of the bath tub and the hand grip part of the bail element being able to be brought into a position of use above the tub edge. Here it may be readily gripped by a person getting into or out of the bath tub. As compared with conventional bath tub access aids, which are attached by a vise-like clamping means on the bath tub, this type of bath tub access aid is characterized in that it may be detached from the bath tub and possibly stored in some other place to save space when it is not being used.

Support means may be provided, using which the arch-like hand grip arrangement may be supported on the inner or outer side wall of the bath tub, when a person getting into or leaving the bath tub takes hold of it so that the bail element does not assume an oblique position and jeopardize safety on getting into or out of the bath tub. Preferably the support means are placed or able to be placed on the longitudinal beams above and/or underneath the respective coupling points. Accordingly it is possible to prevent oblique positioning of the bail element in the opposite direction. The support means may be provided with depth adjustment means, using which the distance between the base part, more particularly the longitudinal beams, and the inner or outer side wall of the bath tub may be changed. For instance, setting screws mounted as depth adjustment means and able to be adjusted more particularly in the support means may be provided.

Preferably height adjustment means are provided for height adjustment of the bail element. Accordingly different heights of the position of use of the hand grip part, and more especially of the transverse beam, may be set in order to provide for adaptation to different heights of the persons getting in an out of the bath tub.

Further advantageous developments and convenient forms of the invention will be understood from the following detailed descriptive disclosure of embodiments thereof in conjunction with the accompanying drawings.

BRIEF DESCRIPTION OF THE DRAWINGS

FIG. 5 is a perspective representation of a third working example of the holding device in accordance with the invention in the case of use thereof as a hand or steadying grip.

FIG. 6 is a side elevation of the holding device of FIG. 5.

FIG. 7 is a perspective representation of the individual components of the holding device in accordance with FIG. 5.

FIG. 8 is a side view of the arrangement of FIG. 7.

FIG. 9 is a perspective representation of a fourth working example of the holding device in accordance with the invention, also in the case of use thereof as a hand grip.

FIG. 10 is a side view of the holding device in accordance with FIG. 9.

DETAILED DESCRIPTION

Figure 1:
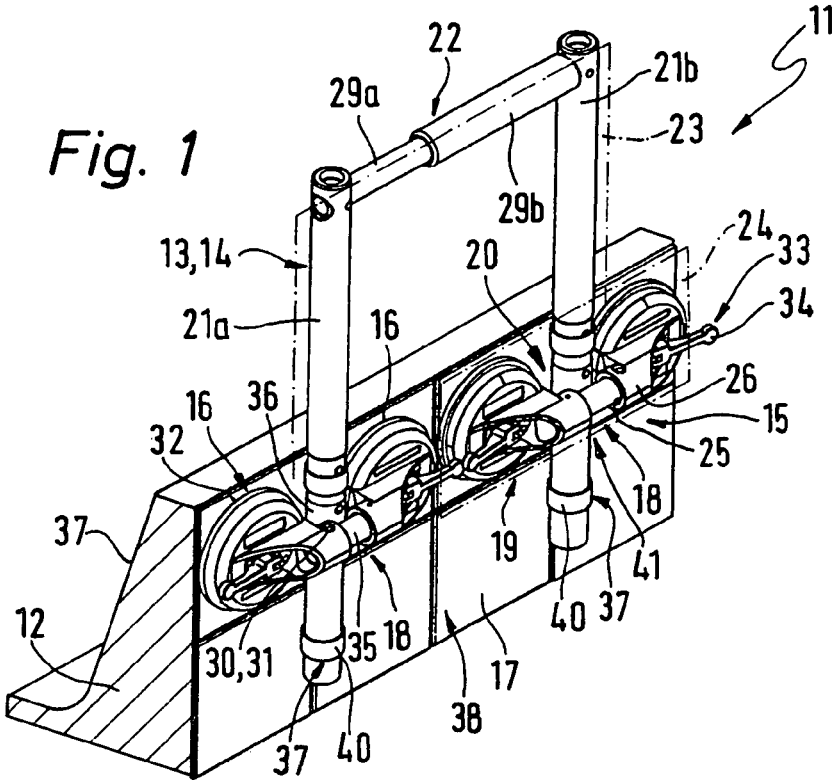
FIG. 1 is a perspective representation of a first working example of the holding device in accordance with the invention during use thereof as bath tub access aid.
Figure 2:
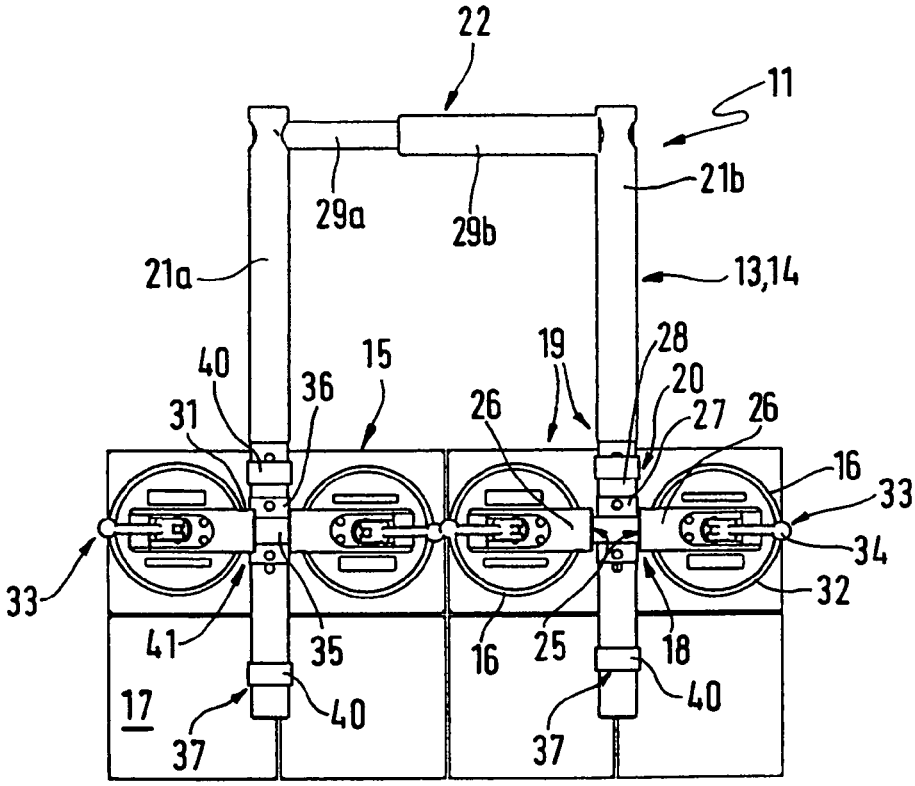
FIG. 2 is a side view of the holding device of FIG. 1.
Figure 3:
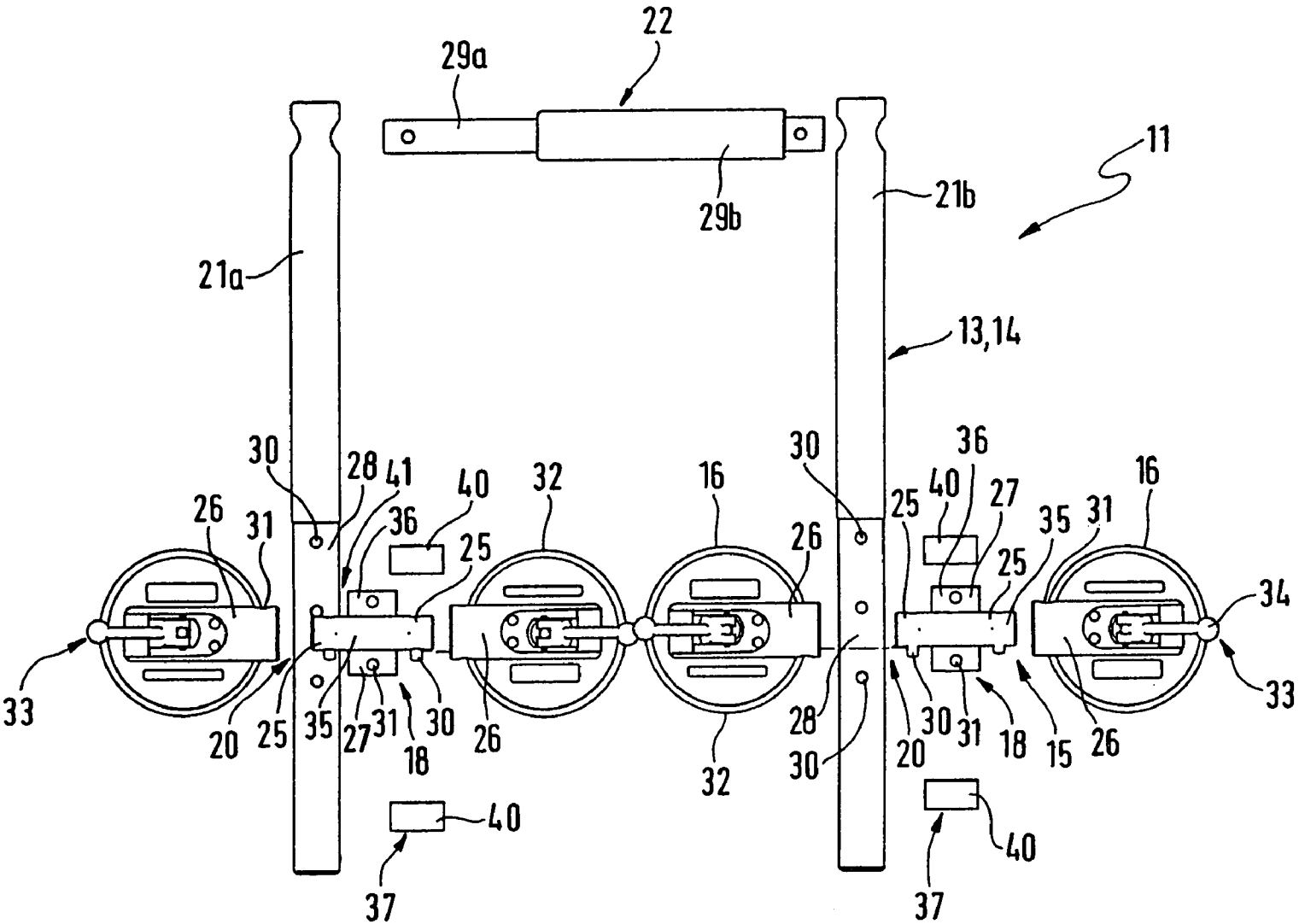
FIG. 3 shows the individual components of the holding device of FIG. 1.

FIGS. 1 through 3 show a first working embodiment of the holding device 11 in accordance with the invention. The holding device 11 can, as illustrated for example in FIGS. 1 through 3, serve as a bath tub access aid, more specifically for elderly or infirm persons to hold on to when getting into or leaving the bath tub 12. The holding device 11 possesses a hand grip arrangement 13, which in the example, has the shape of a bail element 14. The hand grip arrangement 13 is provided with an attachment means 15, which possesses at least two pairs of suction heads 16 of which the hand grip arrangement 13 is able to be fixed to an even surface of the sanitary sector, for example a wall tile 17 and may be detached from same. The hand grip arrangement 13 is coupled or able to be coupled by way of coupling means 18 with each pair of suckers 19 between the respective suction heads 20 at coupling points 20 of a pair of suckers 19.

The hand grip arrangement 13 illustrated in FIGS. 1 through 3 in the form of the bail element 14 possesses a base part, coupled at two coupling points 20 at least by way of coupling means 18 with at least two pairs of suckers 19, in the form of mutually parallel longitudinal beams 21*a* and 21*b* and a hand grip part, joined to and running athwart the base part, in the form of a transverse beam 22 detachably connected with the two longitudinal beams 21*a* and 21*b* using plug connecting means. The longitudinal beams 21*a* and 21*b* and the transverse beam 22 define a bail plane 23, which when the pairs of suckers 19 are aligned parallel to each other, extend in parallelism to the suction plane 24 defined by the pairs of suckers 19.

The transverse beam 22 possesses longitudinal adjustment means for its length adjustment so that in accordance with needs different lengths of the transverse beam 22 may be set. As illustrated in FIGS. 1 through 4 for example the transverse beam 22 is made up of two telescoping tube parts 29*a* and 29*b*, the length adjustment being able to be performed by telescoping the two tube parts 29*a* and 29*b* inward and outward. The longitudinal beams 21*a* and 21*b* are in accordance with the first working example of integral design, each longitudinal beam 21*a* and 21*b* being coupled at a coupling point 20 by way of coupling means in the form of node members 18 with a pair of suckers 19 as suction heads 16. The node members 18 are designed in the form of separate components so that dependent on requirements differently designed node members 18 may be employed in order to produce different connections of the longitudinal beams 21*a* and 21*b* with the respective pairs of suckers 19. The node members 18 are designed as plug connection parts and possess two node member side first pins 25 extending in opposite directions, on which the first sleeves 26 (described in more detail in the following) formed on the respective suction head 16 may be slipped. Between the two first pins 25 of the node member 18 a second sleeve 27 (on the node member side) is arranged, into which a second pin 28, arranged on the respective longitudinal beam 21*a* and 21*b* and on the longitudinal beam side, may be inserted.

The first pins 25 on the node member side and the first sleeves 26 on the suction head side and furthermore the second sleeve 27 on the rod member side and the second pin 28 on the longitudinal beam side are able to be locked together by detent means. As detent means more particularly detent pins 30 able to be thrust back against the force of springs are provided, which automatically snap back into corresponding detent wells or pits 31, more particularly detent holes, when the associated pin 25 and sleeve pairs 26, 27 and 28 are plugged together. The detent as claimed in claim 30 are located on the first pins 25, on the node member side, and on second pins 28 on the longitudinal beam side, whereas the detent wells or pits 31 are provided on the sleeves 26 on the suction head side and the sleeves 27 on the node member side.

As shown more particularly in FIGS. 3, 4, 7 and 8 the first pins 25 on the node member side are cylindrical in design and are internally hollow. The detent pins 30 located thereon protrude from the outer enveloping face of the respective first pin 25. Each detent pin 30 is connected with a spring (not illustrated), which extends through the cavity of the associated first pin 25 and abuts the inner wall. The force of the spring urges the detent pin 30 permanently into its active detent position so that a thrust must be applied against the force of the spring to shift the detent pin 30 from its active position into its released position or setting. On slipping the associated first sleeves 26 on the suction head side onto the first pins 25, which are on the node member side, the detent pin 30 is accordingly firstly thrust back and snaps back automatically into its active detent position as soon as the associated detent well 31 assumes a position over the detent pin 30. The locking together of the second sleeve 27 on the node member side with the second sleeves 28 on the longitudinal beam side takes place in a corresponding fashion.

The first sleeve 26 on the suction head side and located on the respective suction head 16 possesses an internal diameter, which is of such a size that the first sleeve 26 may be slipped over a first pin 25 on the node member side. The first sleeve 26 merges integrally with a suction plate 32 of the suction head 16. The suction plate 32 consists of rubber-like flexible material and is arranged on the bottom side of the respective suction head 16. In this case the suction plate 32 extends in a radial direction around and past the housing of the suction head 16. Above the suction plate 32 the suction head housing contains a cavity, in which the middle portion of the suction plate 32 may be drawn upward. During such drawing up the outer portion of the suction plate 32 rests against the bottom side of the suction head housing. The respective suction plate 32 is provided with an actuating means 33 with which the suction plate 32 may be shifted between an inactive and an active position. In the inactive position the section plate 32 rests loosely on the suction head housing and is not urged toward the suction head housing. In the active positioning means 33 the section plate 32 on the contrary is urged upward toward the suction head housing. In this case the actuating means 33 acts at the center of the section plate 32. The actuating means 33 comprises a stud (not illustrated) attached to the section plate 32, from which it stands up vertically, such stud extending through the cavity, arranged above the section plate 32, in the suction head housing and protruding at the top side (opposite to the section plate 32) from the suction head housing, where on the stud an actuating lever 34 is pivoted, which adjacent to the pivot axis has an eccentric part (not illustrated), which bears against the top side of the suction head housing. In the inactive position the portion, which is nearer to the pivot axis, of the eccentric part engages the top side of the suction head housing so that the section plate 32 is relieved. If the actuating lever 43 is swung out of the inactive position into the active position, the part, which is further removed from the pivot axis, of the eccentric part will engage the top side of the suction head housing and will be supported here so that the section plate 32 will assume its drawn up position. A return spring also engage the section plate 32 such spring shifting the plate 32 back into its initial position from the active position into the inactive position (on pivoting the actuating lever 34).

In accordance with the first working example illustrated in FIGS. 1 through 3 of the holding device 11 in accordance with the invention the node member 18 comprises two parts, namely a first node part 35, on which the 11 the first pins 25, on the node member side, are located and a second node part 36, arranged in another plane, on which the second sleeve 27 on the node member side is located. In the attached state of the holding device 11 on a bath tub 12 the first node part 35 has the coupled suction heads 16 lying above the second node part 36 with the coupled longitudinal beam so that the longitudinal beam is more or less clamped between the pair of suckers 19 and the inner or outer side face 38 and 39 of the bath tub. This offers the advantage that there is a certain pre-fixing of the longitudinal beams 21*a* and 21*b* so that same may rest against the inner or outer side face 38 and 39, if the person getting into or leaving the bath tub 12 wishes to steady himself by holding the transverse beam 22 so that transverse forces, pulling forces and thrust forces are transmitted to the longitudinal beams 21*a* and 21*b*.

Preferably support means 37 are provided, of which the longitudinal beams 21*a* and 21*b* may engage the inner or outer side face 38 and 39 of the bath tub 12. Owing to the arrangement of the support means 37 any gap still left between the longitudinal beams 21*a* and 21*b* and the inner or outer side face 38 and 39 of the bath tub 12 is bridged over so that an oblique position of the longitudinal beams 21*a* and 21*b* is prevented, something which ensures safe getting into and out of the bath tub 12. The situation may occur in which the top tub edge projects past the top edge of a possibly tiled outer side face 38 so that the resulting gap would permit a certain degree of oblique setting of the longitudinal beams 21*a* and 21*b*. This as well is prevented by the support means 37.

The support means 37 are preferably located above and below the respective coupling points 20 so that an even supporting effect of the longitudinal beams 21*a* and 21*b* may be produced while using the transverse beam 22 for steadying movement toward the bath tub 12, more especially on getting into the tub, or for movement out of the tub 12, more particularly away from the bath tub. As depicted in FIGS. 1 through 3 for example as support means support rings 40 may be provided, which may be slipped on the respective longitudinal beams 21*a* and 21*b*, more particularly in a vertically adjustable fashion. Preferentially, the support means 37 comprise material designed to engage the inner or the outer side wall 38 and 39 of the bath tub 12 without damage. Rubber material is more particularly preferred.

Vertical adjustment means 41 are provided for height adjustment of the bail element 14 so that the hand grip part and more particularly the transverse beam 22 may be arranged at different levels dependent on the height of the person getting into or out of the bath tub 12 above the tub edge. Preferably such height adjustment means are in the form of detent pins 30 on the respective longitudinal beams 21*a* and 21*b* arranged particularly at regular intervals over each other and adapted to cooperate with corresponding detent wells 31 in the second sleeve 27 on the node member side. When the two pairs of suckers 19 are therefore attached to the inner or outer side wall 38 and 39 of the bath tub 12, the longitudinal beams 21*a* and 21*b* may be shifted up or down within the associated second sleeves 27 on the node member side, in which they are received, locking in position being possible by the detent pins 30, on the longitudinal beam side, fitting into the detent wells or pits 31 on the sleeve side.

Figure 4:
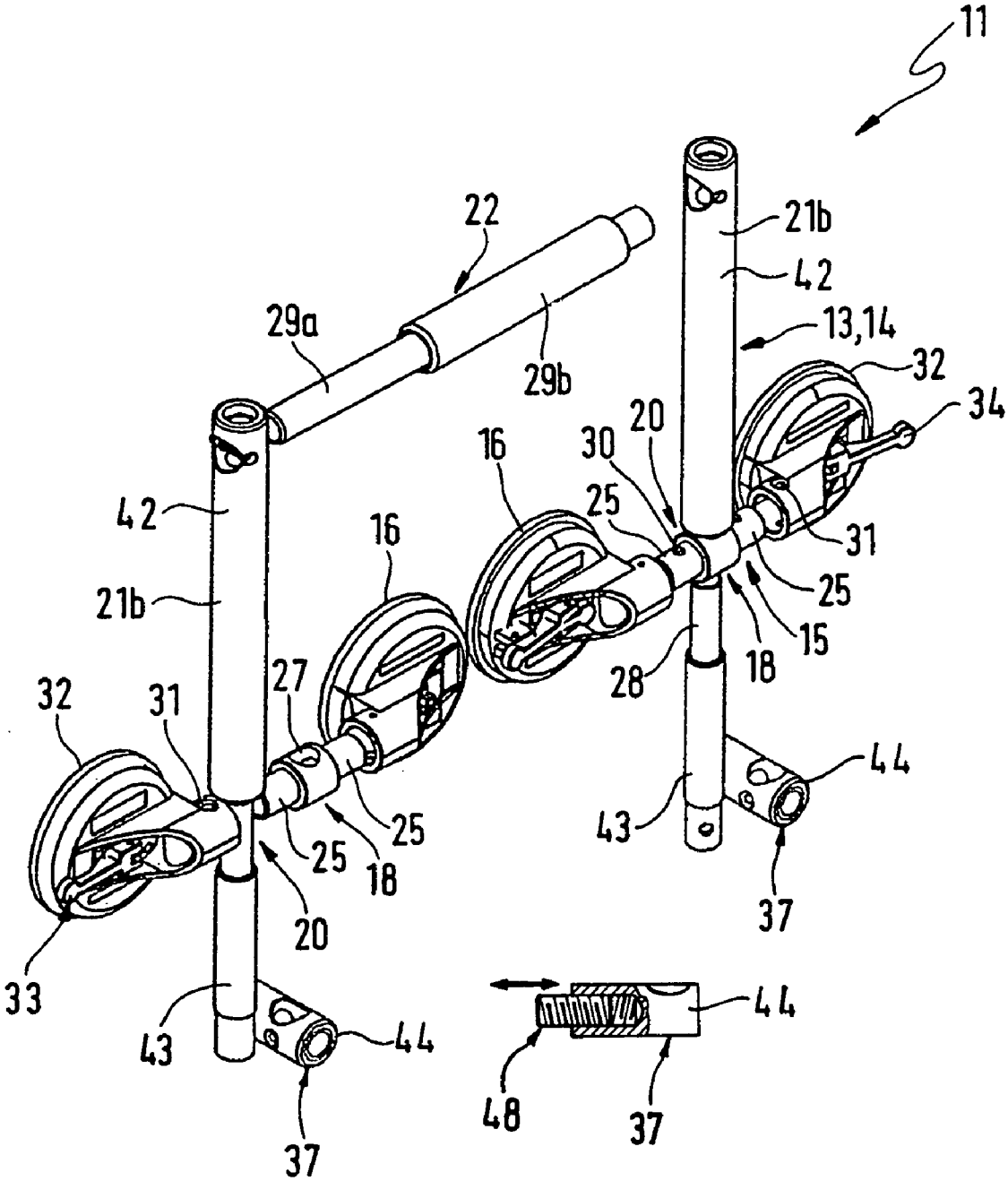
FIG. 4 is a perspective representation of the individual components of a second working example of the holding device in accordance with the invention, also in the case of use thereof as a bath tub access aid.

FIG. 4 shows a second working example of the holding device 11 in accordance with the invention, which is also designed as a bath tub access aid. This working example differs from the first working example primarily owing to the different design of the node members 18. Integral node members are provided here so that the pairs of suckers 19 and the associated longitudinal beams 21*a* and 21*b* can be so connected together that they together define or comply with a plane. At each end the node member 18 possesses a first pin 25 on the node member side, and generally in the middle between the two first pins 25 (and connected integrally with same) a second sleeve 27 on the node member side, the second sleeve 27 having its receiving opening aligned perpendicularly to the alignment of the first pins 25 so that the pairs of suckers 19 and the longitudinal beams 21*a* and 21*b* may be plugged together at a right angle. A further departure from the first working example is that the longitudinal beams 21*a* and 21*b* are made in two parts and comprise a longitudinal beam top part 42 and a longitudinal beam bottom part 43.

For coupling with the node member 18 firstly the longitudinal beam bottom part 43 is inserted through the second sleeve 27 on the node member side and then secured by connecting means, as for example screw means, on the longitudinal beam top part 42. The longitudinal beam bottom part 43 is in this case able to be turned in the second sleeve on the node member side so that the respective pair of suckers 19 may be pivoted around a pivot axis coinciding with the longitudinal direction of the longitudinal beams 21*a* and 21*b* with the result that same may be applied to surfaces with different slopes. Accordingly it is for example possible to arrange the bath tub access aid in a corner, in which case one pair of suckers 19 may be secured at the longitudinal side and the other pair of suckers can be arranged at the end of the bath tub 12. A further departure from the first working example is the design of the support means 37, which are designed in the form of distance pieces 44 projecting athwart the respective longitudinal beams 21*a* and 21*b*. The distance pieces 44 may also be arranged above and below the respective coupling points 20. In the distance pieces 44 depth adjustment means 48 may be arranged, which permit an adjustment of the distance between the longitudinal beams and the inner or outer side wall 38 and 39 of the bath tub 12. As depth adjustment means set screws 48 may for example be provided which are arranged in an adjustable manner in the distance pieces 44 and as required may be screwed out of the distance pieces or screwed farther into them.

As vertically adjustable support means it is also possible to have rotatable eccentrically mounted adjustment rings (not illustrated) so that by turning the respective adjustment ring a different distance may be set between the longitudinal beams and the respective side wall of the bath tub.

FIGS. 5 and 6 show a third working example of the holding device 11 in accordance with the invention, which serves as a hand grip. Here as well a hand grip arrangement 13 is provided in the form of a hand grip rod 45 on which two pairs of suckers 19 are attached, that is to say at each end by way of a respective node member 18. The grip rod 45 may be of telescoping design in a manner similar to the transverse beam 22 employed in the bath tub access aid so that the length of the grip rod is variable more particularly to ensure that the suction heads 16 may always be placed with their full areas on a wall tile 17 and not, as would be the case with non-extensible grip rod, over a joint gap between tiles. In the case of the third working example node members 18 are employed which are identical to those of the second working embodiment.

Figure 11:
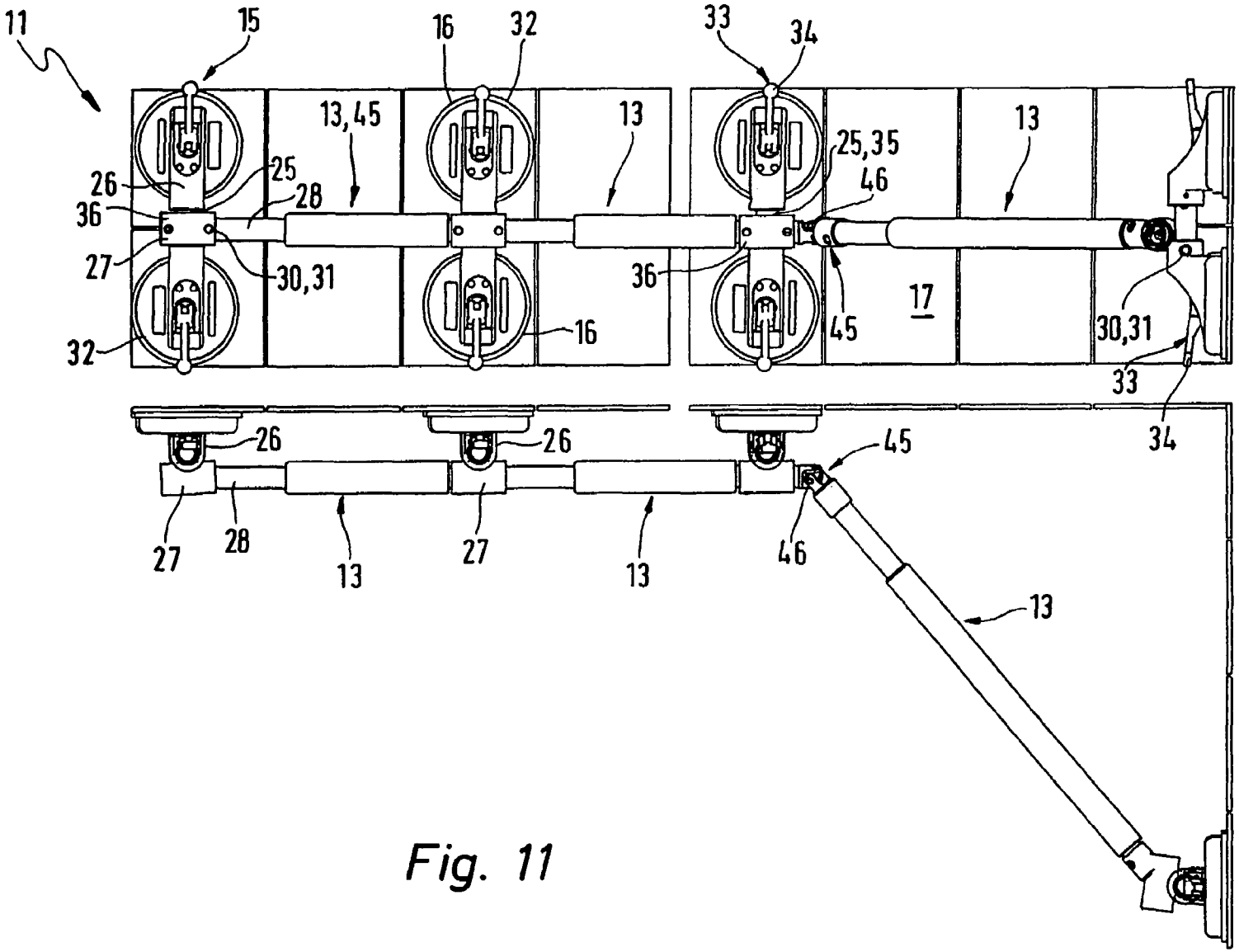
FIG. 11 is a side view together with a corresponding plan view of the holding device in accordance with FIG. 9, several such holding devices being connected together for use in a corner or arris.

In FIGS. 9 through 11 a fourth working example of the holding device 11 in accordance with the invention is represented, which is also provided in the form of a hand grip. The fourth working example differs from the third one since node members 18 with a different configuration are employed. The node members 18 utilized here are identical to those in the first working example and are therefore made in two pieces with the difference that in the mounted state of the holding device 11 the first node part 35 with the coupled suction heads 16 lies underneath the second node part 26 with the coupled grip rod 45 so that there is a relatively large distance between the grip rod 45 and the wall. This offers the advantage that the grip rod may be safely used by persons with large hands.

As depicted in FIG. 11 such a node member 18 renders it possible to connect more than two pairs of suckers 19 with each other, for example by inserting a long rod 45 through several second sleeves 27 or to couple two grip rods 45 with each other at the second sleeves 27 on the node member side. It is also possible to insert a universal joint member 45 with its universal joint 46 in a respective second sleeve so that the holding device 11 may be continued past the corner.

The invention claimed is:

1. A holding device for use in a sanitary sector, the holding device comprising a hand grip arrangement provided with an attachment means comprising at least two sucker pairs, each sucker pair having a pair of suction heads for holding the hand grip arrangement firmly in position on an even surface, and coupling means for coupling or allowing the hand grip arrangement to be coupled with each sucker pair at coupling points lying between the suction heads of each sucker pair, wherein the coupling means are in the form of node members separate from the hand grip arrangement, at each end of a node member a suction head of a respective pair of suction heads is provided and between the ends of a node member, the hand grip arrangement is coupled, the node members are in the form of plug connection parts first pins formed at one of a respective node member and an associated sucker pair are received and locked in first sleeves with detent means, formed in the other of the respective node member or the associated sucker pair, and at least one second pin is formed on one of the respective node member and the hand grip arrangement and a second sleeve for receiving and locking the second pin is formed on the other of the respective node member and the hand grip arrangement, each node member is designed so that the associated pair of suckers is coupled by means of pivot means turning around a pivot axis in the longitudinal direction of the part, coupled to the respective node member of the hand grip arrangement, with the hand grip arrangement in a pivoting manner and the node member comprises a first node part on which the first pins on the node member side are located and a second node part arranged in another plane on which the second sleeve on the node member side is located.

2. The holding device as set forth in claim 1, wherein the first pins are provided on the respective node member and the first sleeves are provided on the associated suction pair and the second pin is provided on the hand grip arrangement and the second sleeve is located on the respective node member.

3. The holding device as set forth in claim 1, further comprising detent means for the locking together of the second pin with the second sleeve, the detent means comprising detent pins able to be depressed against the force of springs, which automatically snap back into corresponding detent wells when the associated pin and sleeve pairs are plugged together, the detent pin being on the pins and the detent wells on the sleeves.

4. The holding device as set forth in claim 1, wherein the hand grip arrangement is an arched bail element with a base part coupled at two coupling points at least by node members, with at least two pairs of suckers and a hand grip part aligned athwart the base part, with which it is connected, the base part and the hand grip part defining a bail plane, which extends parallel to a suction plane defined by the sucker pairs when the sucker pairs are aligned parallel to each other.

5. The holding device as set forth in claim 4, wherein the base part is constituted by two mutually longitudinal beams and the hand grip part is constituted by at least one transverse beam extending athwart and between the longitudinal beams.

6. The holding device as set forth in claim 4, wherein the holding device can serve as a bath tub access aid for getting into or out of a bath tub, the pairs of suckers can be detachably secured to an inner or outer side wall of the bath tub and the hand grip part of the bail element can be shifted into a position of use above the bath tub edge.

7. The holding device as set forth in claim 6, wherein support means are provided for supporting the bail element at the inner or outer side wall of the bath tub.

8. The holding device as set forth in claim 7, wherein the support means are arranged or able to be to be arranged on longitudinal beams above and/or underneath the respective coupling points.

9. The holding device as set forth in claim 7, wherein the support means are provided with depth adjustment means for changing the distance between the base part of the bail element and the inner or outer side wall of the bath tub.

10. The holding device as set forth in claim 9, wherein the depth adjustment means are set screws adjustably held in the support means.

11. The holding device as set forth in claim 9, wherein for depth adjustment the support means possess eccentrically mounted adjustment rings which are able to be turned.

12. The holding device as set forth in claim 6, further comprising height adjustment means for setting the height of the bail element.

* * * * *